US008579328B2

(12) United States Patent
Dobner

(10) Patent No.: US 8,579,328 B2
(45) Date of Patent: Nov. 12, 2013

(54) HOLDING APPARATUS HAVING ADJUSTMENT APPARATUS AND SEPARATE CLOSING APPARATUS, ATTACHABLE TO A HANDLE

(75) Inventor: Christian Dobner, Pinsdorf (AT)

(73) Assignee: Fischer Sports GmbH, Ried/Innkreis (AT)

( * ) Notice: Subject to any disclaimer, the term of this patent is extended or adjusted under 35 U.S.C. 154(b) by 101 days.

(21) Appl. No.: 13/129,946

(22) PCT Filed: Nov. 19, 2009

(86) PCT No.: PCT/AT2009/000450

§ 371 (c)(1),
(2), (4) Date: May 18, 2011

(87) PCT Pub. No.: WO2010/057240

PCT Pub. Date: May 27, 2010

(65) Prior Publication Data

US 2011/0225772 A1 Sep. 22, 2011

(30) Foreign Application Priority Data

Nov. 19, 2008 (AT) ..... A 1801/2008

(51) Int. Cl.
*A63C 11/00* (2006.01)

(52) U.S. Cl.
USPC ..... 280/821; 280/819; 280/822

(58) Field of Classification Search
USPC ..... 280/821, 819, 822, 826; 135/65, 72
See application file for complete search history.

(56) References Cited

U.S. PATENT DOCUMENTS

| | | | | |
|---|---|---|---|---|
| 5,110,154 | A | 5/1992 | Street | |
| 5,123,674 | A * | 6/1992 | Bagneres et al. | 280/821 |
| 5,356,322 | A * | 10/1994 | Bakalis | 441/57 |
| 5,516,150 | A * | 5/1996 | Goode et al. | 280/821 |
| 6,502,862 | B1 | 1/2003 | Lenhart | |
| 6,526,592 | B1 * | 3/2003 | Best | 2/161.1 |
| 6,637,773 | B1 * | 10/2003 | Trinen et al. | 280/821 |
| 7,014,210 | B2 | 3/2006 | Manninen et al. | |
| 7,797,800 | B2 * | 9/2010 | Beltramello | 280/821 |

FOREIGN PATENT DOCUMENTS

| | | | |
|---|---|---|---|
| EP | 2090339 | A1 | 8/2008 |
| WO | 02062434 | A1 | 8/2002 |
| WO | 2007134475 | A1 | 11/2007 |

OTHER PUBLICATIONS

Austrian Search Report dated Jun. 30, 2009.

* cited by examiner

*Primary Examiner* — Hau Phan
(74) *Attorney, Agent, or Firm* — Laurence A. Greenberg; Werner H. Stemer; Ralph E. Locher

(57) ABSTRACT

A handle for a cane has a holding apparatus for a hand. The apparatus is attached or can be attached to a handle and includes an attachment section, which encloses the hand at the side of the back of the hand at least in the region between the thumb and index finger, and a wrist section, which is connected to the attachment section and substantially encloses the wrist or the back of the hand and which is connected to the handle by another attachment section on the side of the palm. The wrist section has an adjustment apparatus so that the circumference of an opening defined by the wrist section can be varied. A closing apparatus is provided separate from the adjustment apparatus which, when open, allows the hand to be removed from the holding apparatus and inserted into the holding apparatus.

11 Claims, 6 Drawing Sheets

HOLDING APPARATUS HAVING ADJUSTMENT APPARATUS AND SEPARATE CLOSING APPARATUS, ATTACHABLE TO A HANDLE

BACKGROUND OF THE INVENTION

Field of the Invention

The invention relates to a handle for a stick or pole having a receiving device for a hand fastened or fastenable to said handle, said receiving device having a fastening section, which covers the back of the hand at least in the region between the thumb and the forefinger, and a wrist section, which is connected to said fastening section, essentially covers the wrist and the back of the hand, and is connected to said handle via a further fastening section facing the palm of the hand, said wrist section having an adjustment device for adjusting the circumference of an opening defined by said wrist section.

Handles having such receiving devices are basically known for a wide variety of sticks or poles, particularly for alpine skiing, cross-country skiing, hiking, and Nordic walking.

Such type of handle is known from EP 357 517 B1, wherein a wristband is provided which is connected to the stick via fastening sections at the palm and the back of the hand at the level of the center of rotation. This is supposed to allow particularly good transmission of force and stick control during cross-country skiing.

Basically, from a biomechanical point of view, the hands should be held in a very relaxed position while walking or running with sticks or poles. The handle should only be held a little tighter when the pole is planted on the ground. After that, forces are largely transmitted by the known receiving devices closing around the hand. The propulsive force from propulsion up to the final push-off is essentially transmitted to the stick or pole by means of the receiving device. As said force is transmitted via the hand receiving device, the wristband-shaped receiving device has to fit very tightly on the hand, i.e. it has to close firmly around the hand as is e.g. known from EP 357 517 B. Disadvantageously, this does not allow quick insertion or pull-out into or from the receiving device, because especially when the receiving device is put on, it may be or even has to be adjusted individually by means of an adjustment device provided in the wrist section.

A wide variety of adjustment devices are known in the art. E.g. EP 0 357 517 B discloses a Velcro® adjustment device wherein the wrist section has overlapping section parts.

Further, a Velcro® adjustment device is also known from EP 908 207 A1, wherein the fastening loop is deflected at first. In addition, EP 908 207 A1 also discloses self-fixing buckles.

One disadvantage is that is takes quite some time to exactly adjust such receiving device; another disadvantage is that such receiving device will often be distorted during fastening so that the hand will not be held covered in the center.

EP 357 517 B teaches that the entire receiving device may be detached from the handle, but it has the particular disadvantage that a coupling device for coupling the receiving device to the handle will remain between the thumb and the forefinger, and therefore the hand may not be used freely e.g. for rifle shooting in biathlon or for eating and drinking during breaks.

Basically, handles having an adjustment device and an additional fastening device are already known. However, they do not allow easy insertion into or pull-out from the receiving device.

For example, U.S. Pat. No. 5,110,154 A discloses a glove having a strap system for fastening it to a ski pole, wherein a wristband is provided that may be adjusted by means of a Velcro®. Another strap is provided which may be fastened to the back of the glove by means of a Velcro®. Thus, two length adjustable straps are provided to adjust the glove to the individual user. U.S. Pat. No. 6,502,862 B1 also discloses a pole handle having a detachable receiving device having a strap fitting around the wrist, and the size of said strap may be adjusted by means of a Velcro®. In addition, the loop is connected to said pole handle via a palm-sided connection element and a back-of-the-hand-sided connection element, with said back-of-the-hand-sided strap being connectable to said wristband by means of snap buttons.

WO 02/062434 A1 also discloses a handgrip for a skiing pole having a receiving device having a length adjustable wristband as already known. In addition, a thumb-sided element is provided that is connected to said handgrip via a control strap, which strap is length adjustable by means of a Velcro®.

BRIEF SUMMARY OF THE INVENTION

Therefore, the present invention aims to provide a handle as set forth above allowing the hand to be inserted into or pulled out from the receiving device easily and quickly with only one hand, and allowing the hand to be completely detached from the receiving device after it has been pulled out.

According to the invention, this aim is reached by providing a separate closing device, which is independent from the adjustment device, and if said closing device is in the open position, the hand may be removed from or inserted into the receiving device.

By providing a separate closing device, which is independent from the adjustment device (which is provided for individual adjustment to various hand sizes), the hand may be removed from or inserted into said receiving device most quickly and easily without changing the individual adjustment settings to said hand. Thus, by providing said separate closing device, the step of individual adjustment is disengaged from the step of closing, thus providing a handle having a receiving device that may be put on or removed most quickly and easily. The closing device is desirably located in the fastening section for easy and quick opening and closing.

The circumference of the opening defined by the wrist section cannot be adjusted when the closing device is in its closed position. This means that, advantageously, any individual adjustment settings, particularly of the wrist section, to various hand sizes cannot be altered by said closing device. In other words, the separate closing device, which is independent from the adjustment device in the wrist section, is only intended to allow opening and closing the receiving device, i.e. provide a kind of quick fastening device, but it is not supposed to allow individual adjustment to various hand sizes, which is done using the adjustment device.

In order to allow easy and ergonomic insertion into and pull-out from the receiving device, the closing device desirably extends essentially in the longitudinal direction of the fastening section, forming, in its open position, a slit-shaped opening widening from the connection between the fastening section and the handle towards the wrist section. Basically, a wide variety of quick closing or fastening means may be considered for said closing device, such as e.g. snap buttons, ratchet buckles, zippers, etc.

The use of a zipper for the closing device will reliably guarantee quick opening and closing. In addition, if a zipper is used, the receiving device may only be closed in one particular way, thus reliably avoiding unintentional change of adjustment settings when opening or closing the zipper.

The receiving device advantageously has an articulated connection in the back-of-the-hand region, particularly in the transition region between the fastening section and the wrist section, in order to transmit into the wrist section only as little as possible of the force acting from the stick or pole onto the receiving device mainly in the direction of the fastening section. In this context, the receiving device advantageously also has an articulated connection in the palm region, particularly in the transition region between the further fastening section and the wrist section. Such articulated connection(s) reliably keep(s) forces from the fastening section from distorting the wrist section, which would be uncomfortable for the user. Rather, said wrist section may be preferably set at a right angle with respect to the forearm and will remain closely fitting around the hand even during propulsion movements, thus providing improved fit and more comfortable use.

Another disadvantage of prior art receiving devices is that they are usually made of resiliently flexible material and will therefore collapse when the hand is pulled out, so they have to be spread before the hand may be inserted. Therefore, in order to provide a receiving device that will remain in stable shape to a certain degree without collapsing when the hand is pulled out, and will yet provide high comfort during use, at least parts of the receiving device are advantageously made up of two layers, with the inner layer near the hand being made of a relatively soft, flexible material and the outer layer being made of a relatively stiff, inflexible material.

For even more comfort during use, advantageously the closing device is seamlessly connected to the remaining receiving device to reliably avoid any friction or pressure as usually caused by seams etc., giving rise to pain and blisters on the hand. Said closing device, particularly said zipper, may be connected to the remaining receiving device by e.g. thermo-taped seams, high frequency welding, ultrasound welding or any other laminating techniques. This will reliably avoid any bruises due to friction or pressure. In addition, the individual layers of the two- or multiple layer receiving device may be connected seamlessly as well.

Hereinafter, the invention will be described in greater detail using the preferred embodiment depicted in the drawings. However, the invention is not restricted thereto. In the drawings,

DESCRIPTION OF THE INVENTION

Figure 1:
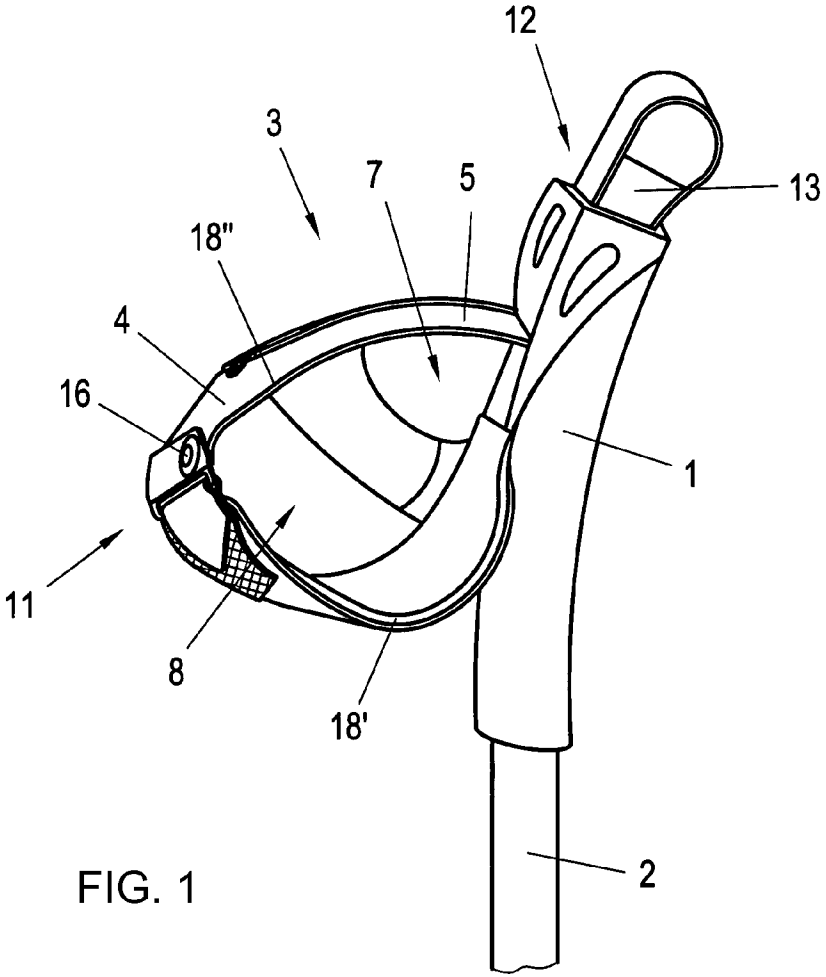
FIG. 1 is a perspective view of a handle with a receiving device without a hand.

FIG. 1 shows a handle 1 connected to a stick or pole 2. Instead of a conventional loop, a receiving device 3 for receiving a hand is connected to said handle 1. Essentially, said receiving device 3 has a wrist section 4, which closes around the wrist section and the back and the palm of the user's hand, a fastening section 5, which essentially rests on the back of the hand between the thumb and the forefinger, and a further fastening section 6 facing the palm of the hand, with said wrist section 4 being connected to said handle 1 via said fastening sections. Thus, said receiving device 3 has an opening 7 to insert the thumb, and an opening 8 to insert the remaining fingers.

Figure 2:
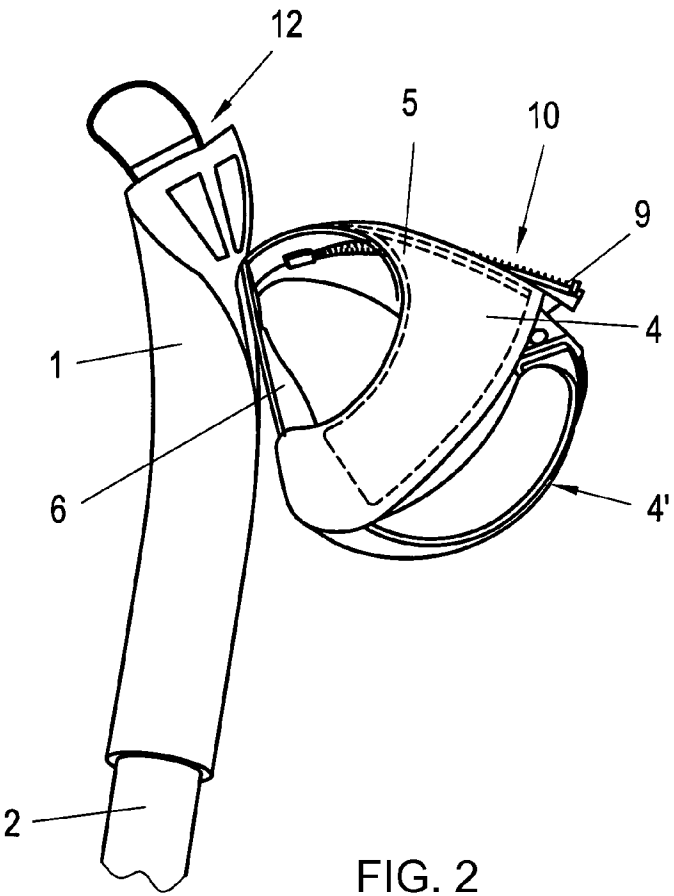
FIG. 2 is another perspective view of the handle.
Figure 3:
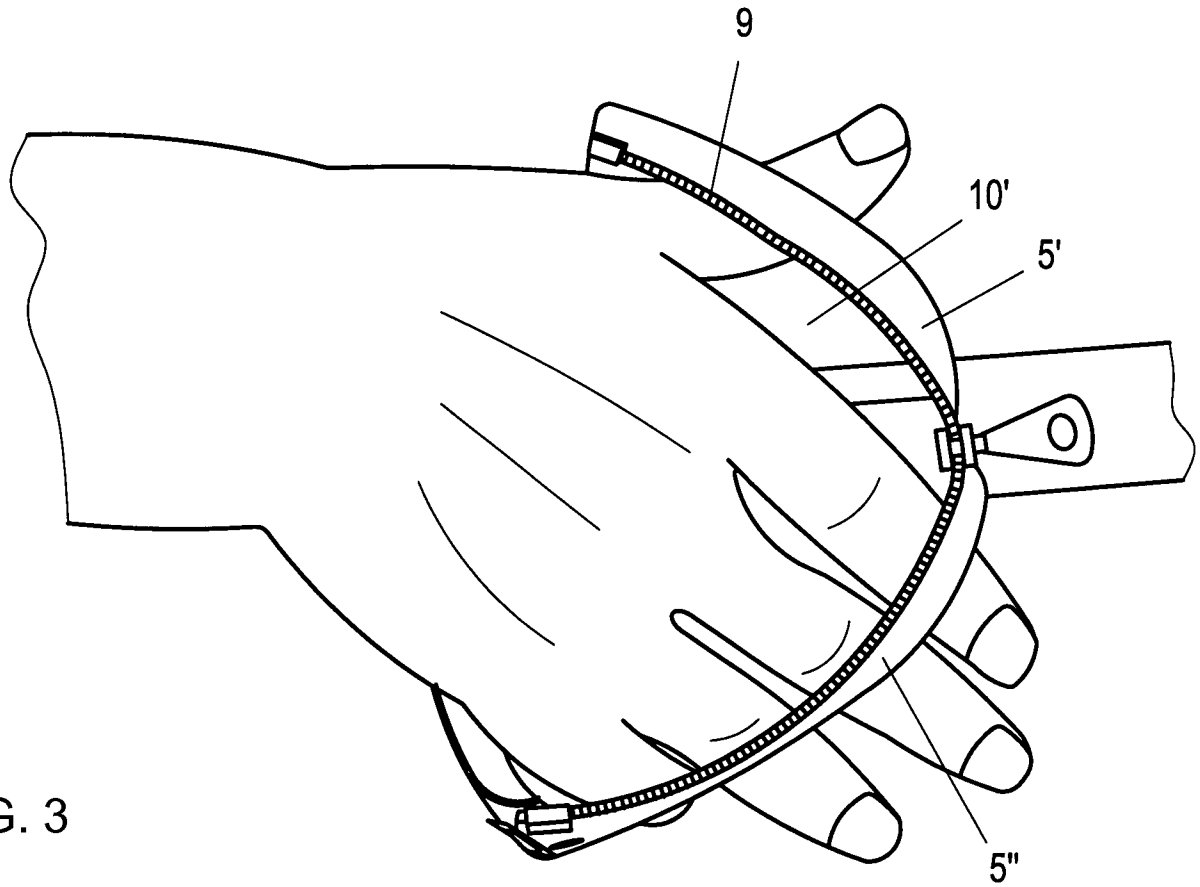
FIG. 3 is another perspective view of the receiving device in its open position, with a hand being inserted into the receiving device.

As particularly shown in FIGS. 2 and 3, a zipper 9 is provided as a closing device 10 in the region of fastening section 5. Using said zipper, said fastening section 5 may be divided into two sections 5', 5", thus forming an essentially V-shaped opening 10', with the tip of said V pointing towards said handle 1. Said opening considerably increases the circumference of wrist section 4 so that the thumb and the remaining fingers may easily be inserted through openings 7, 8 until the hand has a good grip of handle 1.

Figure 4:
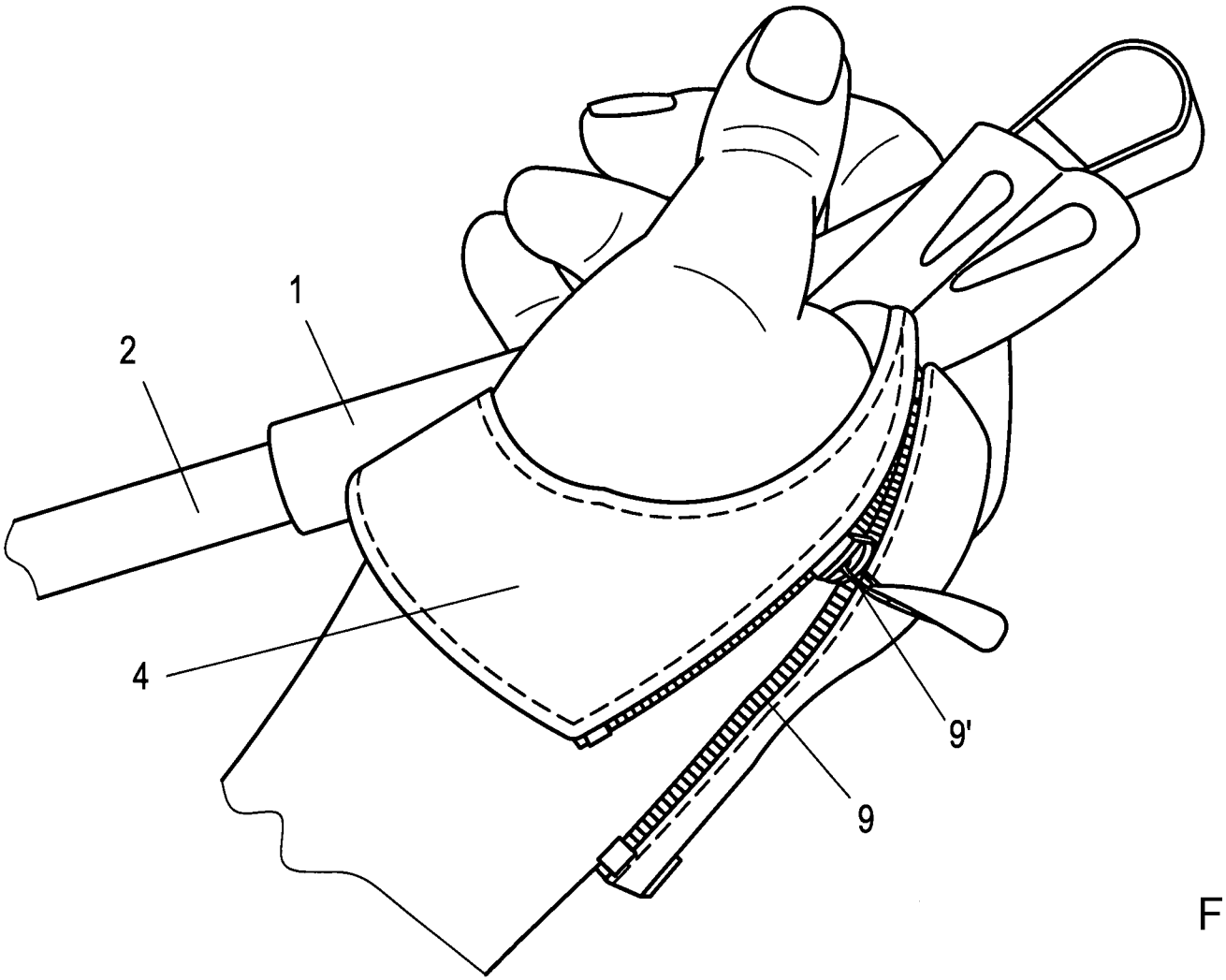
FIG. 4 is a perspective view of the handle; a hand is received in the receiving device, and the closing device is being closed.

Then, as particularly shown in FIG. 4, a closing part 9' of zipper 9 may be moved from its open position near the handle to its closed position far from the handle. FIG. 4 shows an intermediate position during the closing process.

Figure 5:
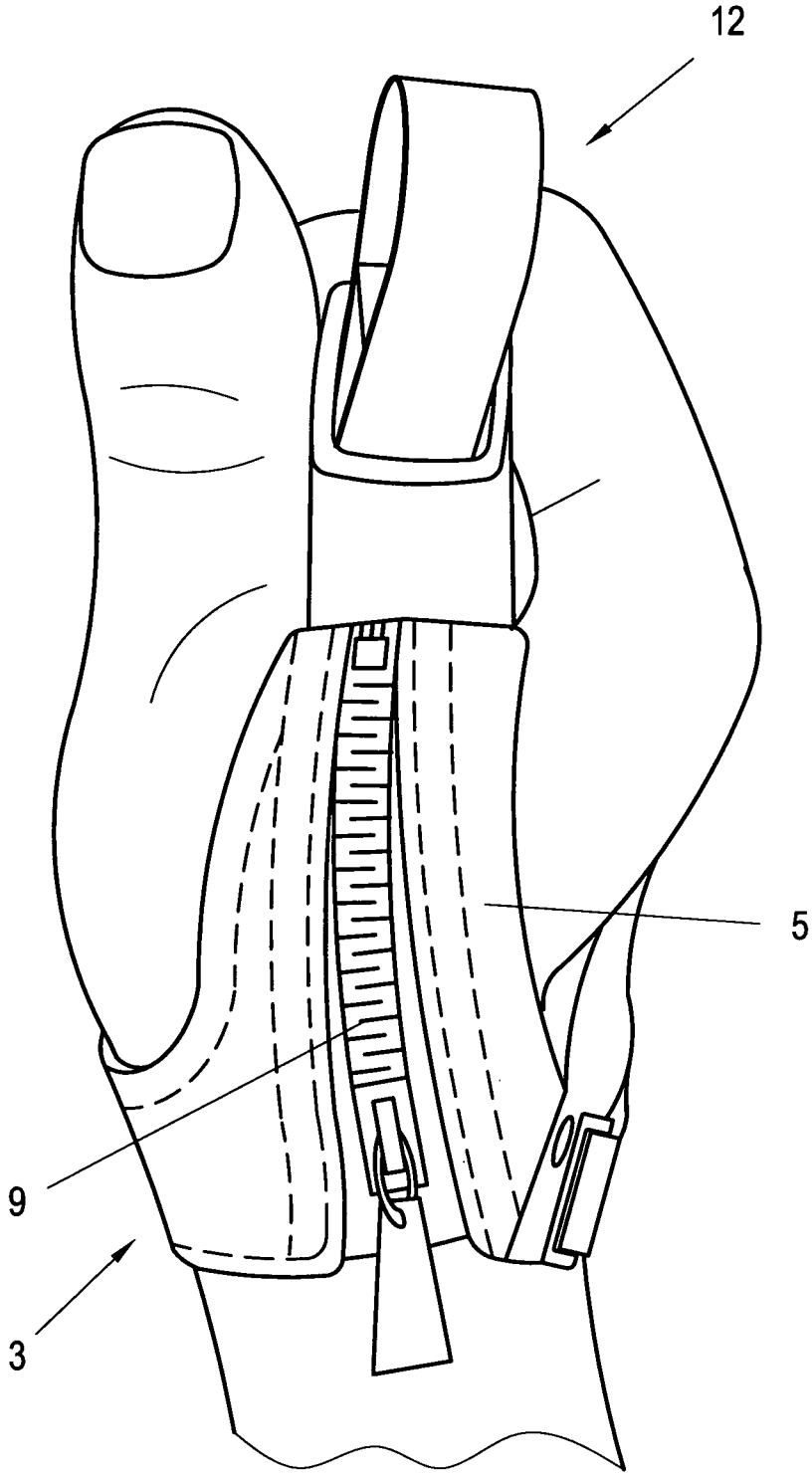
FIG. 5 is a view of a fastening section with the receiving device in its closed position; a hand is received in the receiving device.
Figure 6:
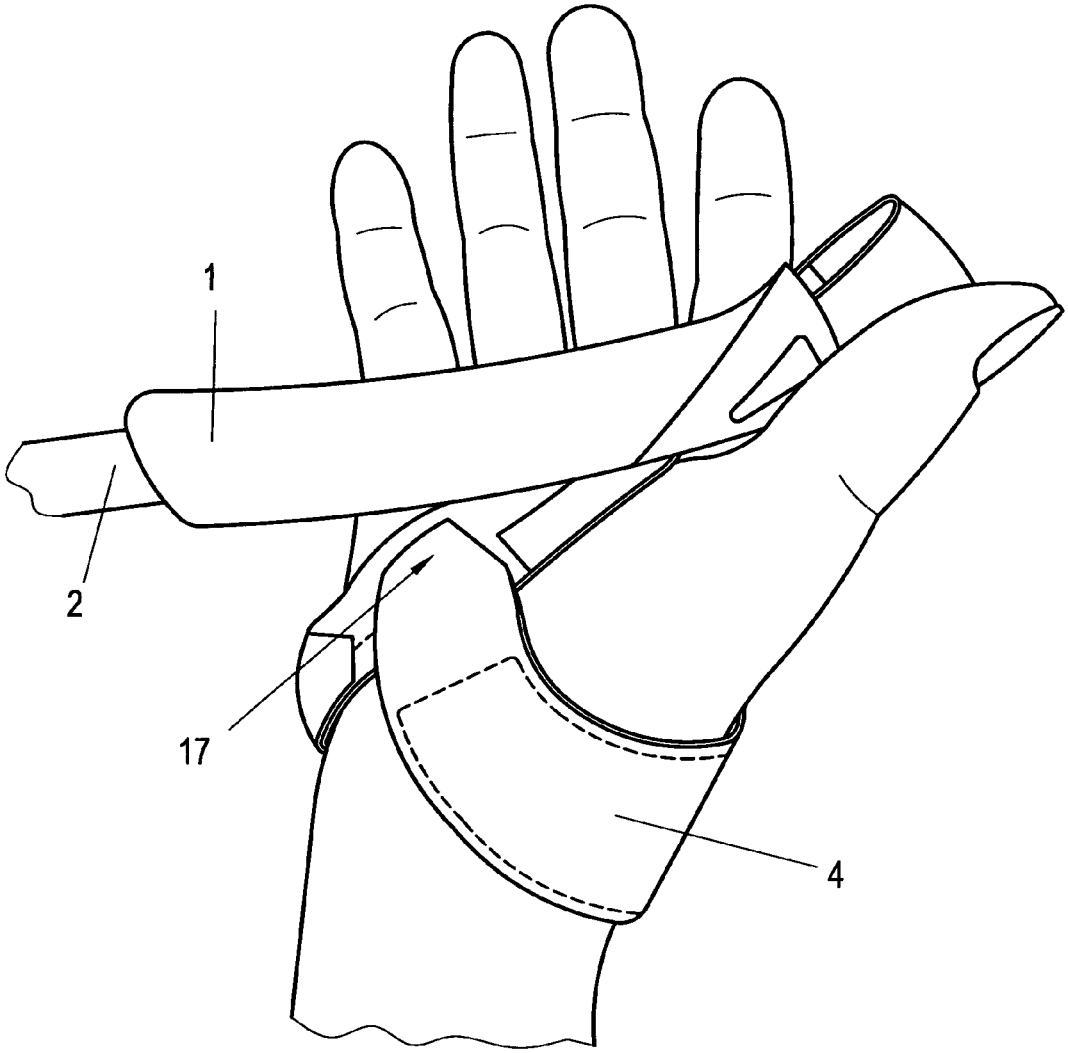
FIG. 6 is another view of the palm of a hand received in the receiving device.
Figure 7:
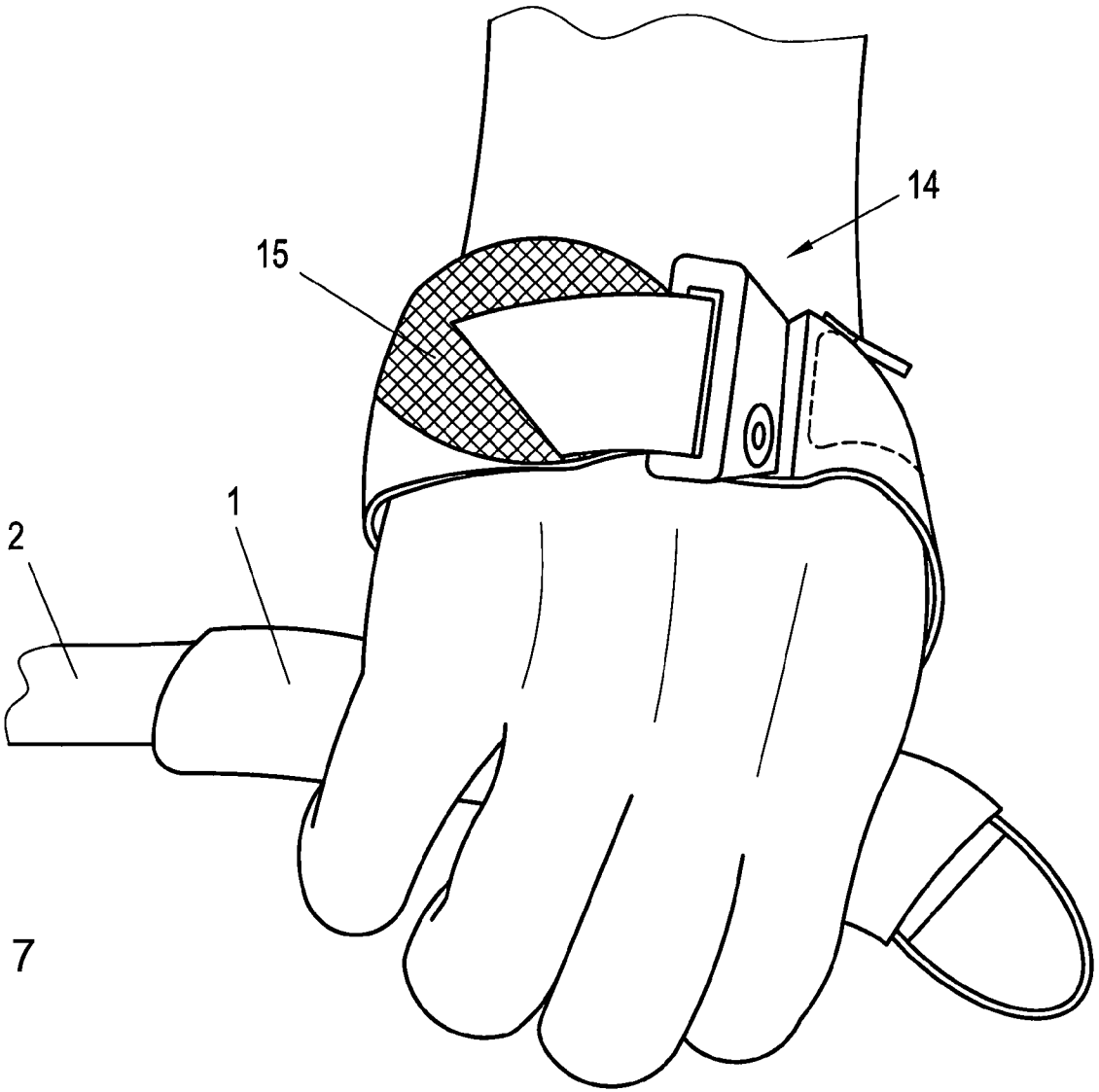
FIG. 7 is another view of the back of a hand received in the receiving device.

FIG. 5 shows a receiving device 3 in its closed position. I.e. zipper 9 is closed, so that the V-shaped opening 10' of FIG. 3 is closed. As shown in FIG. 5, closing said zipper 9 will easily and particularly quickly establish a firm and stable connection between the hand and handle 1. Closing said closing device 9 will not result in individual adjustment to the hand. Rather, such adjustment is provided by adjustment device 11 in wrist section 4 and an adjustment device 12 integrated in handle 1 as known per se from prior art for individual adjustment of the lengths of fastening sections 5 and 6. Adjustment section 12 has a guide with a wedge 13 slidably mounted therein to allow definition of various lengths of fastening sections 5 and 6 by means of a clip fastening. Adjustment device 11 has a Velcro® 15 deflected by a deflection device 14 as known per se from prior art, so that the circumference of opening 4' defined by wrist section 4 may be adjusted steplessly in order to fit said wrist section 4 closely to the hand. Such adjustment device 11 is known per se for individual adjustment. However, while in conventional handles it is also used to insert the hand into and pull it out from receiving device 3, the present invention provides a closing device 9 for easy and quick insertion and pull-out. Thus, insertion and pull-out are conveniently disconnected from individual adjustment.

An articulated connection 16 is provided in the transition region from wrist section 4 to fastening section 5. The axis of rotation of said connection is essentially perpendicular to the plane in which said receiving device 3 extends. This keeps the force transmitted to receiving device 3 via fastening section 5 from being transmitted freely to wrist section 4. Thus, advantageously, any transfer of drag forces may be largely avoided. This interruption of drag force transmission may advantageously keep said wrist section 4 from being forced out of its position closely fitting around the hand. Rather, wrist section 4 will remain in its original position around the wrist even during propulsion movements, thus increasing user comfort. For example, a kind of rivet connection may be provided for this purpose, with the two parts 4, 5 connected by said rivets being mounted pivotally towards each other.

In addition, an articulated connection 17 is also provided on the palm side of the hand between wrist section 4 and palm-sided fastening section 6. For example, a seam or adhesive connection may be provided to allow a certain degree of movement between these two sections 4 and 6.

As can be seen particularly in FIGS. 1 and 2, at least parts of receiving device 3 are made up of two layers (of course, a three or multiple layer construction may also be considered), with the inner layer, i.e. the layer contacting the hand, being made of a soft, flexible layer 18', e.g. neoprene, mesh materials or similar. The continuous outer layer 18" is made of a relatively stiff, inflexible material, such as e.g. polypropylene, acryl nitrile butadiene styrol, polymide or similar. Advantageously, this will keep the receiving device 3 from collapsing when there is no hand inserted. This helps inserting or pulling out the hand even more quickly in particular through closing device 9. Particularly advantageous materials are thermoplastic materials that may be heated using a commercially available heater, e.g. a hairdryer, to become thermoplastic. Particularly advantageous materials have a relatively low softening temperature in the range of 60-80° C. and allow individual adjustment to the user's hand after heating without burning the skin. Layers 18' and 18" are seamlessly connected in order to avoid pressure or friction marks on the skin.

The invention claimed is:

1. A handle assembly for a stick or pole, comprising:

a receiving device fastened to or to be fastened to a handle grip of the handle assembly, said receiving device being configured to receive a hand with a thumb, an index finger, a palm, a back, and a wrist;

said receiving device having a fastening section configured to cover the back of the hand at least in a region between the thumb and the index finger and a wrist section connected to said fastening section, said wrist section substantially covering the wrist and the back of the hand;

said receiving device including an articulated connection in a region to be disposed at the back of the hand;

a further fastening section facing the palm of the hand and connecting said receiving device to the handle grip of the handle assembly;

said wrist section including an adjustment device for adjusting a circumference of an opening defined by said wrist section; and a closing device separate from and independent of said adjustment device, said closing device having an open position enabling the hand to be removed from or inserted into said receiving device.

2. The handle according to claim 1, wherein said closing device is disposed in said fastening section.

3. The handle according to claim 1, wherein the circumference of the opening defined by said wrist section may not be altered by way of said closing device in the closed position thereof.

4. The handle according to claim 1, wherein said closing device extends substantially in a longitudinal direction of said fastening section, said closing device, in an open position thereof, forms a slit-shaped opening extending from a connection between said fastening section and the handle grip towards said wrist section.

5. The handle according to claim 1, wherein said closing device is a zipper.

6. The handle according to claim 1, wherein said articulated connection is disposed at a transition region from said fastening section to said wrist section.

7. The handle according to claim 1, wherein at least a portion of said receiving device is formed of two layers, including an inner layer near the hand made of a relatively soft, flexible material and an outer layer made of a relatively stiff, inflexible material.

8. The handle according to claim 1, wherein said closing device is seamlessly connected to a remaining said receiving device.

9. A handle assembly for a stick or pole, comprising:

a receiving device fastened to or to be fastened to a handle grip of the handle assembly, said receiving device being configured to receive a hand with a thumb, an index finger, a palm, a back, and a wrist;

said receiving device having a fastening section configured to cover the back of the hand at least in a region between the thumb and the index finger and a wrist section connected to said fastening section, said wrist section substantially covering the wrist and the back of the hand;

said receiving device having an articulated connection in a palm region thereof;

a further fastening section facing the palm of the hand and connecting said receiving device to the handle grip of the handle assembly;

said wrist section including an adjustment device for adjusting a circumference of an opening defined by said wrist section; and a closing device separate from and independent of said adjustment device, said closing device having an open position enabling the hand to be removed from or inserted into said receiving device.

10. The handle according to claim 9, wherein said articulated connection is disposed in a transition region from said further fastening section to said wrist section.

11. A receiving device for a handle grip of a stick or pole, the receiving device comprising:

a fastening section configured to cover a back of a hand at least in a region between a thumb and an index finger thereof;

a wrist section connected to said fastening section and configured to substantially cover a wrist and a back of the hand;

a further fastening section configured to face a palm of the hand and to connect said fastening section and said wrist section to the handle grip of the stick or pole;

at least one of an articulated connection formed in a region to be disposed a the back of the hand or an articulated connection in a palm region of the receiving device;

said wrist section including an adjustment device for adjusting a circumference of an opening defined by said wrist section; and a closing device separate from and independent of said adjustment device, said closing device having an open position enabling the hand to be removed from or inserted into the receiving device.

* * * * *